United States Patent [19]

Slominski

[11] 3,938,204

[45] Feb. 17, 1976

[54] FRAME CONSTRUCTION FOR BOX SPRING ASSEMBLIES

[75] Inventor: Walter V. Slominski, Ann Arbor, Mich.

[73] Assignee: Hoover Ball and Bearing Company, Saline, Mich.

[22] Filed: Apr. 8, 1971

[21] Appl. No.: 132,511

[52] U.S. Cl. ..... 5/255; 5/351

[51] Int. Cl.[2] ..... A47C 23/04

[58] Field of Search ..... 52/247, 282, 207, 236, 52/238, 305, 267, 263, 261

[56] References Cited

UNITED STATES PATENTS

| | | | |
|---|---|---|---|
| 50,883 | 11/1865 | Carre | 5/247 |
| 71,014 | 11/1867 | Huntington | 5/275 |
| 773,911 | 11/1904 | Baker | 5/208 X |
| 893,815 | 7/1908 | Schutt | 5/238 X |
| 1,893,098 | 1/1933 | Murry et al. | 5/247 X |
| 1,904,841 | 4/1933 | Watts | 5/351 X |
| 2,593,831 | 4/1952 | Bank | 5/247 X |
| 2,606,329 | 8/1952 | Connally | 5/238 |
| 3,131,405 | 5/1964 | Andes | 5/305 X |
| 3,487,480 | 1/1970 | Slominski | 5/351 X |

FOREIGN PATENTS OR APPLICATIONS

| | | | |
|---|---|---|---|
| 139,470 | 7/1930 | Switzerland | 5/238 |

*Primary Examiner*—Casmir A. Nunberg
*Attorney, Agent, or Firm*—Olsen and Stephenson

[57] ABSTRACT

A generally rectangular frame for supporting the springs in a box spring assembly consisting of horizontal side and end rails, a plurality of transversely spaced cross rails supported on and extending between the side rails, and a center rail supported on and extending between the end rails and interlocked with the mid portions of the cross rails so as to support the cross rails intermediate their ends. The cross rails and the center rail are longitudinally arched to provide a mattress foundation which is convexly arched in two directions when viewed from above. Telescoping bracket supports are provided for mounting the ends of the center rail on the wood end rails so as to eliminate the necessity for slotting the end rails and uniquely shaped tabs are struck out of the cross rails to enable easy interlocking of the center rail with the cross rails during assembly of the frame. The cross rails are shaped so that they have narrow strips of metal at their ends to enable use of a conventional stapling tool for attaching the cross rail ends to the wood side rails.

3 Claims, 7 Drawing Figures

INVENTOR
WALTER V. SLOMINSKI

BY

OLSEN & STEPHENSON
ATTORNEYS

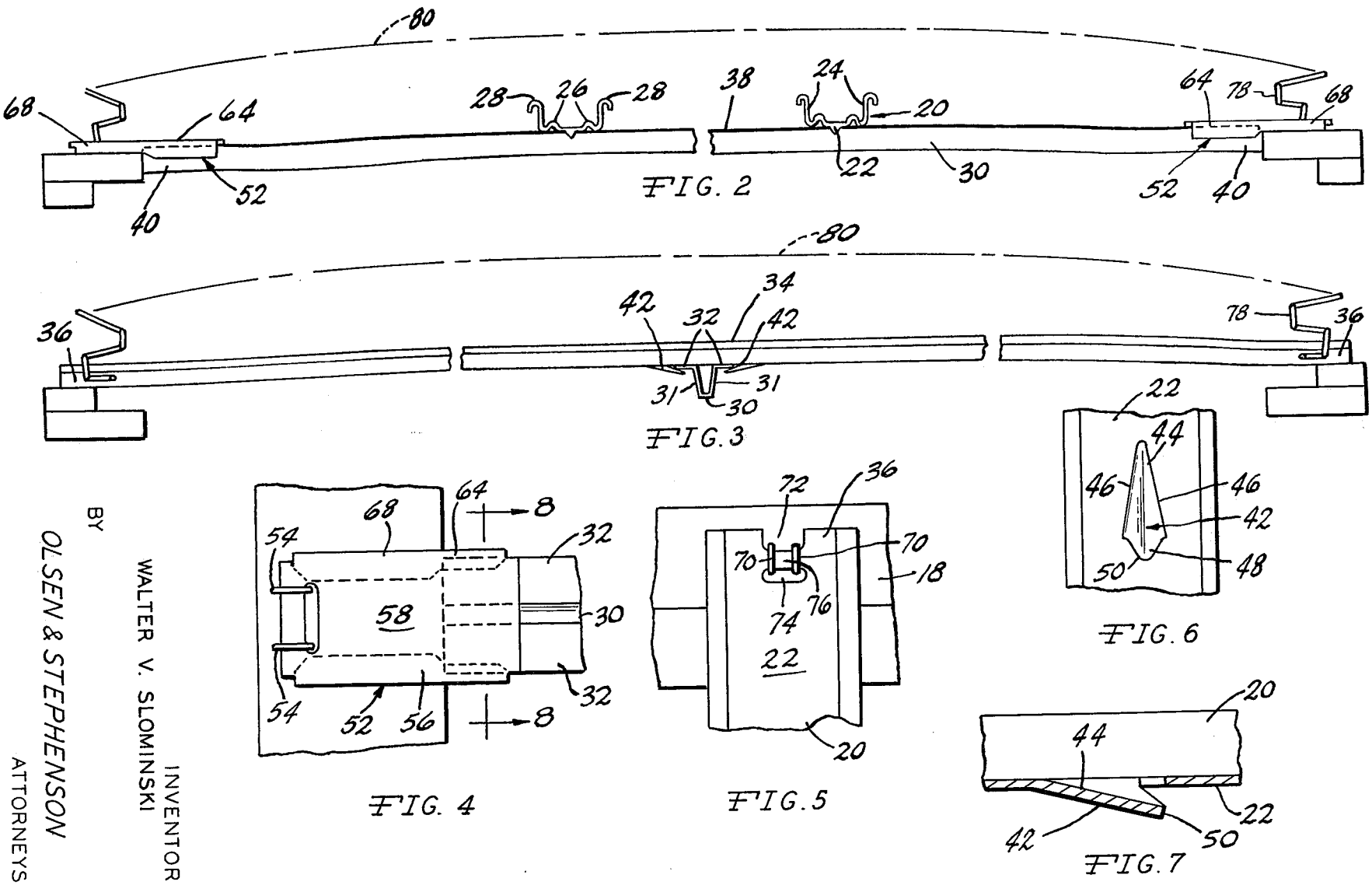
INVENTOR
WALTER V. SLOMINSKI
BY
OLSEN & STEPHENSON
ATTORNEYS

FRAME CONSTRUCTION FOR BOX SPRING ASSEMBLIES

CROSS REFERENCE TO RELATED APPLICATIONS

The present application discloses a box spring frame of the same general type as the frames disclosed in copending applications Ser. No. 886,468 filed Dec. 19, 1969 (U.S. Pat. No. 3,680,157) and Ser. No. 56,933 filed July 21, 1970 (U.S. Pat. No. 3,665,529), owned by the assignee of this application.

BACKGROUND OF THE INVENTION

Box spring assemblies conventionally consist of a rectangular wooden frame having side rails, end rails and slats secured to the side rails and springs mounted on and extending upwardly from the wood frame. The wood is non-uniform, has reliability deficiencies and is becoming increasingly expensive but the introduction of steel or other suitable metals into such a product has heretofore been impractical from the standpoints of weight and economy. The principal object of the present invention, therefore, is to incorporate metal cross rails and a center rail into a box spring frame so as to replace the conventional wood slats with structural members which improve the quality, reliability and uniformity of the frame and, in addition, provide the box spring assembly with a highly desirable convex surface curvature which is important in all mattress foundations.

SUMMARY OF THE INVENTION

The box spring frame construction of this invention comprises substantially horizontal side and end rails formed of wood, a plurality of channel shape metal cross rails which are supported on and extend between the side rails, and a center rail which is supported at its ends on the end rails and is interlocked intermediate its ends with central portions of the cross rails so as to provide support for the cross rails intermediate their ends. The cross rails are prestressed so that they are longitudinally arched and pairs of downwardly extending tabs are struck out of the center portions of the cross rails. The center rail is similarly prestressed so that it is longitudinally arched and the center rail is assembled in a supporting relation with the cross rails by interlocking the center rail with the tabs on the undersides of the cross rails. The tabs that are struck out of the cross rails have downwardly inclined tail portions bent from the cross rails and free head portions which are of a progressively decreasing width in a direction extending away from the tail portions so that the head portions present minimum interference with the center rail during assembly. Telescoping brackets are arranged in a supporting relation with the ends of the center rail and are secured to the end rails to enable mounting of the center rail on the end rails without slotting the end rails. To further facilitate mounting of the cross rails on the side rails, the cross rails are provided with narrow strips of material at their ends to enable stapling of the cross rails to the side rails with a conventional stapling tool.

The longitudinally arched shapes of the cross rails and the center rail provides a base for a spring assembly of uniform thickness which has a top deck that is convexly curved in two directions when viewed from above. As a result, the deck provides a mattress foundation which imparts this identical convexly arched configuration to the top surface of a mattress supported on the spring deck, a characteristic which is acknowledged to be highly desirable in quality bedding. Past box spring assemblies have required layers of cotton to achieve this desirable arched configuration. In addition, the frame of this invention has improved strength characteristics by virtue of the cooperative action of the cross rails and the center rail so that potential sag of the frame during use is substantially eliminated.

Further objects, features and advantages of this invention will become apparent from a consideration of the following description, the appended claims, and the accompanying drawing in which:

FIG. 2 is a longitudinal sectional view of the frame construction of this invention with some parts removed for the purpose of clarity;

FIG. 3 is a transverse sectional view of the frame construction of this invention with some parts removed for the purpose of clarity;

FIG. 4 is a fragmentary top view of a portion of the frame construction of this invention showing the mounting of the center rail on an end rail;

FIG. 5 is a fragmentary top view of another portion of the frame construction of this invention showing the mounting of one end of a cross rail on a side rail;

FIG. 6 is a fragmentary top view of a portion of a cross rail in the frame construction of this invention showing one of the tabs in the cross rail;

FIG. 7 is a longitudinal sectional view of the structure shown in FIG. 6; and

Figure 1:
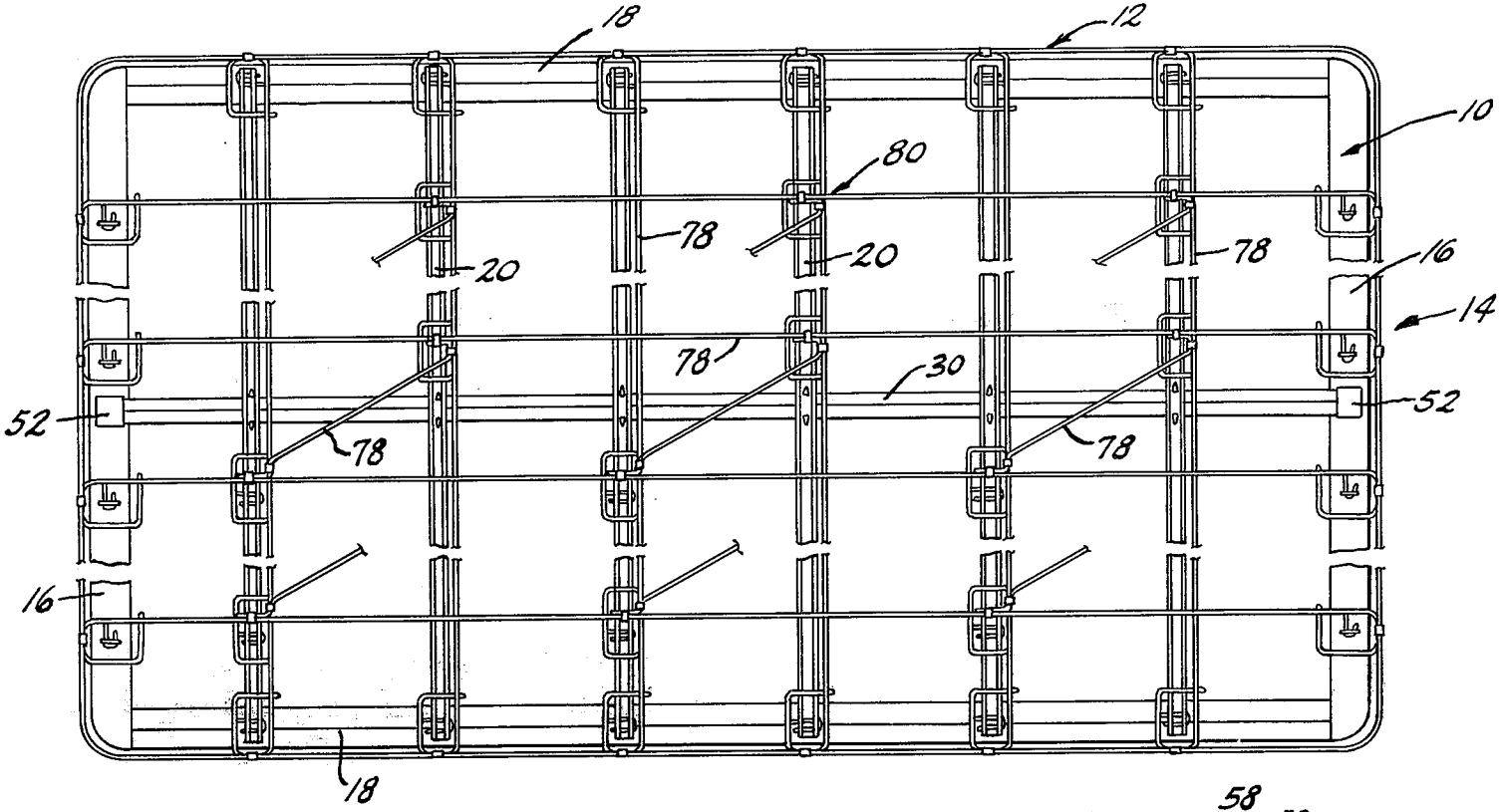
FIG. 1 is a top view of a box spring assembly provided with the improved frame construction of this invention, with some parts removed for purposes of clarity.

With reference to the drawing, the improved frame of this invention, indicated generally at 10, is illustrated in FIG. 1 in assembly relation with a spring assembly 12, the details of which are shown in the aforementioned copending application Ser. No. 886,468 so as to form a box spring 14 that can function as a mattress foundation. The frame 10, which is generally rectangular and is disposed in a horizontal plane in use, includes the usual end rails 16 and side rails 18 which are connected together. In the illustrated form of the invention, the rails 16 and 18 are formed of wood but it is within the purview of this invention to form these rails of metal or the like. Cross rails 20 arranged in a transversely spaced relation are supported at their ends on the side rails 18. As shown in FIG. 2, each cross rail 20 is formed of metal, preferably high strength steel in light gauge and is substantially U-shape in transverse section having a base section 22 and upstanding leg sections 24. For strength purposes, the base section 22 is formed with linear embossments 26 each of which is of a generally inverted U-shape. Also for strength purposes, the upper end of each leg section is provided with an outwardly extending rolled over flange 28. The embossments 26 and flanges 28 cooperate to stiffen the cross rail 20 and enhance its ability to resist bending loads. The frame 12 also includes a center rail 30 which, as shown in FIG. 3, is of generally V-shape having upwardly diverging legs 31 which terminate in outwardly extending flanges 32 at their upper ends. The center rail 30 is also formed of metal, preferably high strength steel in light gauge, so that the legs 31 can be forced toward each other, but the legs will resiliently spring back away from each other to the positions shown in FIGS. 3 and 8 when the force is removed.

As shown in FIG. 3, each cross rail 20 is prestressed so that it is longitudinally arched to locate the center portion 34 of the rail above the end portions 36. Similarly, as shown in FIG. 2, the center rail 30 is prestressed so that it is longitudinally arched to locate its center portion 38 above its end portions 40.

The center rail 30 is interlocked with and arranged in a supporting relation with the center portions 34 of the cross rails 20. This interlocking is achieved by striking tabs 42 (FIGS. 3, 6 and 7) out of the base sections 22 of the cross rails 20 and arranging the tabs 42 in facing pairs. Each tab 42 includes an elongated tail portion 44 which is integrally connected to the base section 22 by bends 46. The tail portion 44 is also transversely bent during the striking process so that it is somewhat concave in shape when viewed from above. Each tab 42 also includes a head portion 48 which is integral with the tail portion 44 but free of the base section 22 so that it terminates in a curved edge 50.

As shown in FIG. 6, the edge 50 is shaped so that the head portion 48 is of a progressively decreasing width in a direction extending away from the tail portion 44. The center rail 30 is assembled with each pair of tabs 42 in each cross rail 20 by forcing the upwardly extending legs 31 of the tail 30 toward each other so as to reduce the spacing between the flanges 32 so that the flanges 32 can be moved into positions between the tab head portions 50, following which the legs 31 are released so that they spring apart and urge the flanges 32 into positions in which they are confined between the tab head portions 50 and the cross rail base sections 22. By virtue of the shape of the head portions 50, the tabs 42 present a minimum of interference with the center rail 30 during manipulation of the rail 30 to interlock it with the cross rails 20. For a more detailed disclosure of the manipulation of the center rail 30 to interlock it with the cross rails 20, reference is made to applicant's aforementioned copending application Ser. No. 56,933.

Figure 8:
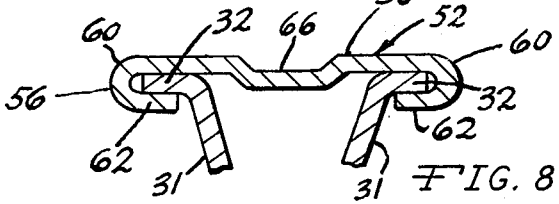
FIG. 8 is an enlarged sectional view of a portion of the frame construction of this invention as seen from substantially the line 8—8 in FIG. 4.

The ends of the center rail 30 are mounted on the end rails 16 by means of brackets 52 which are telescoped over the ends of the center rail 30 and attached by staples 54 (FIG. 4) to the end rails 16. Each bracket 52 consists of a metal body 56 having a top wall 58 which is return bent downwardly upon itself at its transverse edges 60 so as to form edge flanges 62 which are disposed below and extend under the top wall 58. The body 58 has a telescoping portion 64 at one end in which the flanges 62 are spaced below the top wall 58 a distance sufficient to accommodate the flanges 32 on the center rail 30, as shown in FIG. 8. In the telescoping portion 64 of the body 56, the top wall 58 has a center depressed portion 66 which extends downwardly between the flanges 32 to a position in substantial alignment with the flanges 32. The portion 66 thus functions to preclude accidental release of the flanges 32 from their confined positions between the top wall 58 and the flanges 62. The body 56 also includes a mounting portion 68 in which the flanges 62 are flattened against the top wall 58 and supported on the top side of an end rail 16. The staples 54 function to firmly retain the mounting portion 68 against the rail top surface without requiring any slotting of the rail 16. Thus, in the assembly of the frame 10, the brackets 52 are initially telescoped over the ends of the center rail 30 and then secured by the staples 54 to the end rails 16 so that the center rail 20 is substantially midway between the frame side rails 18.

The cross rails 20 are interlocked with the center rail 30 and are secured at their ends to the side rails 18 by staples 70, as shown in FIG. 5. To facilitate installation of the staples 70, each cross rail 20 has its base section 22 provided with a notch 72 and a slot 74 at each end 36 of the cross rail 20. The notch 72 and slot 74 cooperate to provide a narrow strip of metal 76 which can readily be straddled by the staples 70 to thereby permit the use of a conventional stapling tool to secure the ends 36 of the cross rails 20 to the side rails 18. Accordingly, by virtue of the provision of the mounting brackets 52 on the center rail 30 and the narrow strips 76 at the ends of the cross rail 20, the metal components of the frame 10, namely, the cross rails 20 and the center rail 30, are readily secured by conventional staples to the wood components 16 and 18 of the frame 10.

The spring assembly 12 consists of a plurality of springs 78 arranged so that the assembly 12 is of substantially uniform height and many of the springs in the assembly 12 are mounted on the cross rails 20. For this purpose, the cross rails 20 are slotted, as described in detail in copending application Ser. No. 886,468, and the cross rails can function as an assembly jig for the positioning of these springs thus assuring accurate locating and mounting of the springs. The spring assembly 12 includes a top spring surface or deck 80 the general contour of which is indicated in broken lines in FIGS. 2 and 3. By virtue of the longitudinal arching of the center rail 30 and the cross rails 20, the deck 80, on which the bedding mattress is placed, is convexly arched in two directions, namely, directions longitudinally of the rails 20 and 30, when viewed from above. As a result, a mattress supported on the deck 80 will have its top surface of a similar configuration. This convexly arched configuration is intimately associated in the public mind with quality bedding. Furthermore, the longitudinal arching of the rails 20 and 30 in the frame 10 provides the frame 10 with increased resistance to normal loads precluding sagging of the mattress foundation during use.

What is claimed is:

1. A box spring assembly comprising a frame having substantially horizontal side and end rails and a plurality of transversely spaced cross rails supported on and extending between said side rails, each of said cross rails being pre-stressed so that it is longitudinally arched and being secured at the ends thereof to said side rails, the longitudinal arch in a cross rail providing for a location of the center portion thereof above the ends thereof, and a center rail extending transversely of said cross rails and secured at the ends thereof to said end rails, said center rail being connected intermediate the ends thereof to said cross rails and being prestressed so that it is longitudinally arched and has the center portions thereof disposed above the ends thereof, a plurality of springs forming a spring assembly of substantially uniform height and having a top deck, and means on said cross rails providing for the support of at least some of said springs thereon in predetermined fixed positions so that the top deck is convexly arched in two directions when viewed from above as a result of said arching of said cross rails and said center rail, said cross rails being generally U-shaped in transverse section and each having a base section and upright leg sections, said base sections being formed with downwardly extending tabs arranged in pairs and aligned with said center rail, and said center rail being interlocked with and arranged between the tabs in each pair.

2. A generally rectangular frame for a box spring assembly, said frame comprising side and end rails and a plurality of transversely spaced cross rails supported on and extending between said side rails, each of said cross rails being of channel shape in cross section and having a generally horizontal base section and upright leg sections, a center rail extending transversely of said cross rails and secured at the ends thereof to said end rails, said center rail being of generally V-shape in cross section and having generally horizontal flanges at the upper ends thereof extending outwardly in opposite directions, tabs struck out of at least some of said cross rail base sections, said tabs being arranged in pairs inclined downwardly toward each other and spaced apart longitudinally of said cross rails, each of said tabs having a downwardly bent tail portion integral with said base section and a head portion integral with said tail portion and inclined downwardly therefrom at a position below said base section, said head section terminating in an outwardly curved free edge, and said center rail being stressed so that said flanges thereof are urged outwardly into retained engagement between pairs of said tabs, said flanges being positioned between the head portions in a pair of tabs and the base section from which said tabs are struck.

3. A box spring frame according to claim 2 wherein each of said tab head portions has the free edge thereof curved so that said head portion is of a progressively decreasing width in a direction extending away from the tail portion integral with said head portion.

* * * * *